US011519593B1

(12) United States Patent
Liu

(10) Patent No.: US 11,519,593 B1
(45) Date of Patent: Dec. 6, 2022

(54) ROTATABLE LAMP DEVICE

(71) Applicant: Haitang Liu, Jingzhou (CN)

(72) Inventor: Haitang Liu, Jingzhou (CN)

(73) Assignee: Haitang Liu, Jingzhou (CN)

( * ) Notice: Subject to any disclaimer, the term of this patent is extended or adjusted under 35 U.S.C. 154(b) by 0 days.

(21) Appl. No.: 17/674,814

(22) Filed: Feb. 17, 2022

(30) Foreign Application Priority Data

Dec. 29, 2021 (CN) ..... 202123342241.9

(51) Int. Cl.
*F21V 23/06* (2006.01)
*F21V 21/02* (2006.01)
*H01R 31/06* (2006.01)

(52) U.S. Cl.
CPC ..... *F21V 23/06* (2013.01); *F21V 21/02* (2013.01); *H01R 31/06* (2013.01)

(58) Field of Classification Search
CPC .... F21V 21/14–32; F21V 21/02; F21V 23/06; F21V 23/001; A47G 33/06
See application file for complete search history.

(56) References Cited

U.S. PATENT DOCUMENTS 9,441,823 B1 * 9/2016 Chen ..... F21S 4/10
9,677,748 B1 * 6/2017 Chen ..... A47G 33/06
2022/0186895 A1 * 6/2022 Chen ..... F21S 4/10

* cited by examiner

*Primary Examiner* — Anabel Ton
(74) *Attorney, Agent, or Firm* — Bayramoglu Law Offices LLC

(57) ABSTRACT

A lamp device capable of being rotated to plug in at any angle includes a mounting base, wherein side walls of the mounting base are fixedly connected with four fixed supporting feet, wherein the four fixed supporting feet are uniformly distributed on the side walls of the mounting base. A mounting slot is formed inside the mounting base, and a plurality of plug-in connectors are plugged in the mounting slot. Rotating assemblies are arranged inside the plurality of plug-in connectors, and fixing assemblies are arranged on side walls of the plurality of plug-in connectors. The rotating assemblies are arranged for a moveable barrel to rotate on the side walls of the plurality of plug-in connectors through gear shafts and annular racks engaged with the gear shafts to adjust an angle of a lamp mounted in a mounting part without affecting a decorative lighting.

5 Claims, 4 Drawing Sheets

ROTATABLE LAMP DEVICE

CROSS REFERENCE TO THE RELATED APPLICATIONS

This application is based upon and claims priority to Chinese Patent Application No. 202123342241.9 filed on Dec. 29, 2021, the entire contents of which are incorporated herein by reference.

TECHNICAL FIELD

The present invention relates to the technical field of decorative lighting plug-in, in particular to a lamp device capable of being rotated to plug in at any angle.

BACKGROUND

The various decorative lightings are used for decorating a living room, a dining room, a bedroom, a kitchen and a bathroom, and even a walkway, a balcony and a bar counter, thereby decorating the surrounding environment more from the indoor to the outdoor. The modern decorative lightings and lamps are extremely beautiful and have more and more design styles including a classical style, a modern style, a fashionable style, a European style, an American style, a clear style and a luxury style. As a result, the interior lighting enterprises need to have enough foreseeability and innovative consciousness so as to design products satisfying consumers according to their changing needs. With the household lighting effect, the decorative lightings with different styles may have different decorative effects. At Christmas Time, lamps are needed for decorating the Christmas tree.

The following defects or problems exist in the prior art:

In use, a direction needs to adjust in advance for mounting as a current decorative lamp plug-in device cannot rotate generally. As a result, great convenience is brought in mounting as re-mounting is needed if adjusting is needed. In addition, a modern decorative lamp plug-in device is mostly a two-wire type which only can be used for mounting an LED lamp, and is smaller in use range.

SUMMARY

To overcome the defects in the prior art, the present invention provides a lamp device capable of being rotated to plug in at any angle so as to solve the problems in the background art.

To achieve the objective, the present invention adopts a following scheme:

A lamp device capable of being rotated to plug in at any angle includes a mounting base, where the side walls of the mounting base are fixedly connected with four fixed supporting feet which are uniformly distributed on the side walls of the mounting base; a mounting slot is formed inside the mounting base, and a plurality of plug-in connectors are plugged in the mounting slot; rotating assemblies are arranged inside the plug-in connectors, and fixing assemblies are arranged on the side walls of the plug-in parts.

Optionally, plug-in slots are formed in the tops of the plug-in connectors, and the bottoms of the plug-in connectors are fixedly connected with connection plugs. The connection plugs are matched with the plug-in slots. The plug-in connectors are connected to the connection plugs on the bottom through the plug-in slots in the tops end to end.

Optionally, power supply connection ends are fixedly connected inside the plug-in slots, power supply connection slots are formed inside the connection plugs, and the power supply connection ends are matched with the power supply connection slots.

Optionally, connection line ports are arranged inside the power supply connection ends. Three connection lines are arranged inside the connection line ports. The three connection lines are respectively a positive-electrode line, a negative-electrode line and a signal line. Line arranging slots are formed inside the plug-in connectors.

Optionally, each rotating assembly includes a movable barrel, a gear shaft, a rotating shaft, a damping gasket and an annular rack. A movable slot is formed inside the plug-in connector. The rotating shaft is rotatably connected into the movable slot. The gear shaft is fixedly connected onto the side wall of the rotating shaft. The annular rack is fixedly connected onto the inner wall of the movable barrel. The annular rack is engaged with the gear shaft. The movable barrel is rotatably connected inside the plug-in connector through the annular gear and the gear shaft. The damping gasket is fixedly connected to a joint of the movable barrel and the plug-in connector.

Optionally, each fixing assembly includes a mounting part, a fixing ring and a fixing part. The fixing part is fixedly connected on the side wall of the movable barrel. The mounting part is fixedly connected inside the fixing part and the fixing ring is fixedly connected onto the side wall of the mounting part.

Compared with the prior art, the present invention provides a lamp device capable of being rotated to plug in at any angle, which has the following beneficial effects:

1. The rotating assemblies are arranged, so that a movable barrel can rotate on the side walls of the plug-in parts through gear shafts and annular racks engaged with the gear shafts to adjust the angle of a lamp mounted in a mounting part without affecting decorative lighting.

2. The connection line ports are arranged inside the power supply connection ends, so that the decorative lightings can be electrified by being connected with the power supply connection ends through the connection line ports. The positive-electrode line, the negative-electrode line and the signal line are arranged inside the connection line ports, so that the connection line ports can be connected with LED lamps or RGB lamps.

BRIEF DESCRIPTION OF THE DRAWINGS

In order to explain the technical solutions in the embodiments of the present invention or the prior art more clearly, the drawings used in the embodiments or the prior art will be briefly introduced below. Obviously, the drawings in the following description are some embodiments of the present invention. For a person of ordinary skill in the art, other drawings can be obtained based on these drawings without paying creative labor.

Figure 1:
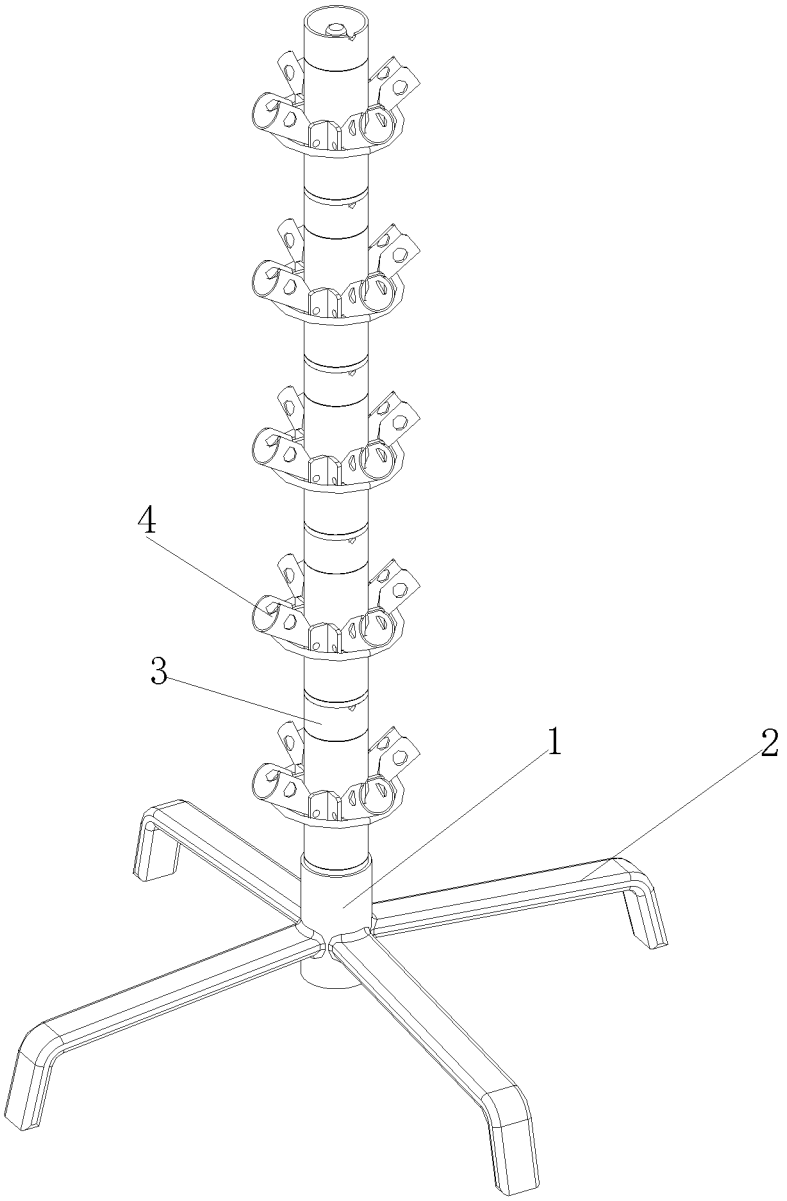
FIG. 1 is a structural diagram of the present invention.

In the figures: 1, mounting base; 2, fixed supporting feet; 3, plug-in connector; 4, mounting part; 5, movable barrel; 6, fixing ring; 7, fixing part; 8, plug-in slot; 9, power supply connection end; 10, connection line port; 11, line arranging slot; 12, power supply connection slot; 13, gear shaft; 14, movable slot; 15, connection plug; 16, rotating shaft; 17, annular rack; 20, rotating assembly: and 21, fixing assembly.

DETAILED DESCRIPTION OF THE EMBODIMENTS

The technical solutions in the embodiments of the present invention will be described clearly and completely in combination with the drawings in the embodiments of the present invention. Obviously, the described embodiments are part of, but not all of, the embodiments of the present invention. Based on the embodiments in the present invention, all other embodiments obtained by a person of ordinary skill in the art without creative efforts shall fall within the protection scope of the present invention.

In the description of the present invention, it is to be understood that orientation or position relationships indicated by terms "vertical", "upper", "lower", "horizontal" and the like are orientation or the position relationships shown in the drawings, are adopted not to indicate or imply that indicated devices or the components must be in specific orientations or structured and operated in specific orientations but only to conveniently describe the present invention and simplify the description, and thus should not be understood as limit to the present invention.

In the description of the present invention, it should also be noted that the terms "arranging", "mounting", "connected" and "connection" should be understood in a broad sense unless otherwise specified and limited, for example, it may be a fixed connection or a detachable connection, or an integrated connection, or a mechanical connection or an electrical connection or a direct direction or a connection through an intermediate or communication inside two components. For those of ordinary skill in the art, the specific meanings of the above terms in the present invention can be understood according to specific situations.

Figure 2:
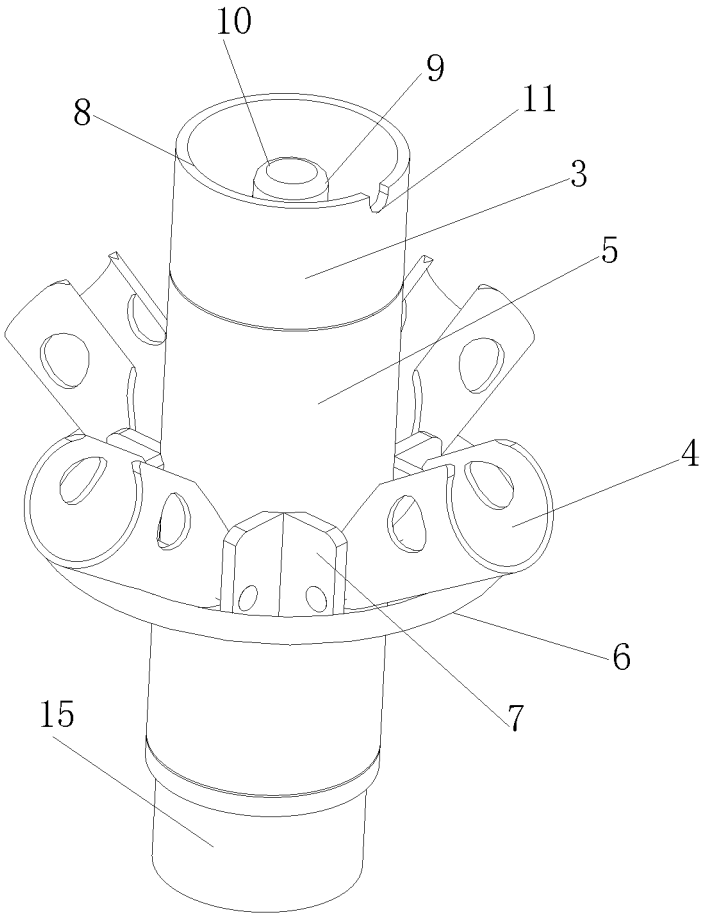
FIG. 2 is a structural diagram of a plug-in connector of the present invention.
Figure 3:
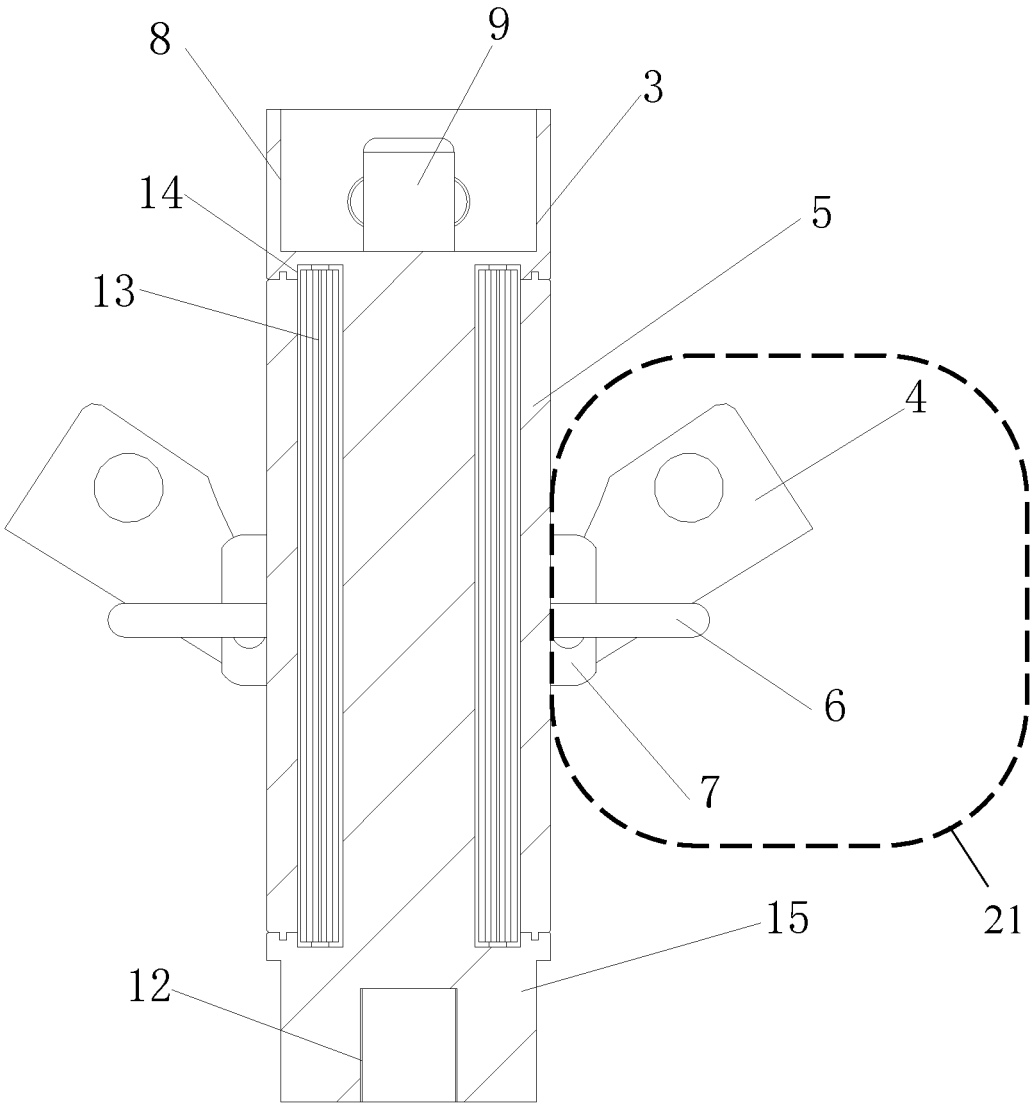
FIG. 3 is a sectional view of the present invention.
Figure 4:
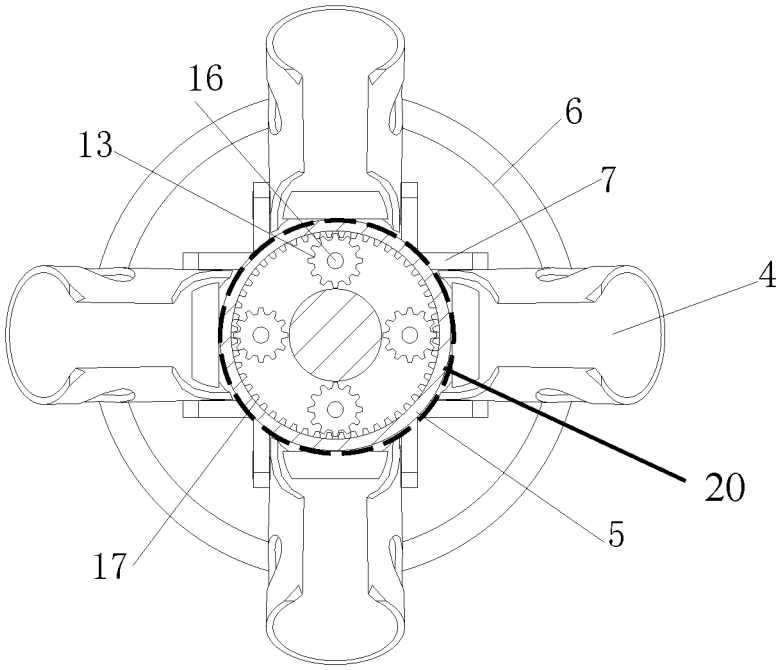
FIG. 4 is a top sectional view of the present invention.

Refer to FIG. 1 to FIG. 4, in the embodiment: a lamp device capable of being rotated to plug in at any angle includes a mounting base 1, where the side walls of the mounting base 1 are fixedly connected with four fixed supporting feet 2 which are uniformly distributed on the side walls of the mounting base 1; a mounting slot is formed inside the mounting base 1, and a plurality of plug-in connectors 3 are plugged in the mounting slot; rotating assemblies 20 are arranged inside the plug-in connectors 3, and fixing assemblies 21 are arranged on the side walls of the plug-in parts 3; the plug-in connectors 3 are plugged in the mounting slot of the mounting base 1, so that the plug-in connectors 3 are fixed inside the mounting base 1 to prevent the plug-in connectors 3 from dropping; and the fixed supporting feet 2 are arranged, so that the mounting base 1 is more stable.

Plug-in slots 8 are formed in the tops of the plug-in connectors 3, and the bottoms of the plug-in connectors 3 are fixedly connected with connection plugs 15. The connection plugs 15 are matched with the plug-in slots 8. The plug-in connectors 3 are connected to the connection plugs 15 on the bottom through the plug-in slots 8 in the tops end to end. The connection plugs 15 are arranged on the bottoms of the plug-in slots 8 in the tops of the plug-in connectors 3, so that the plug-in connectors 3 can be assembled and mounted. Height can be adjusted by mounting the plurality of the plug-in connectors 3.

Power supply connection ends 9 are fixedly connected inside the plug-in slots 8, power supply connection slots 12 are formed inside the connection plugs 15, and the power supply connection ends 9 are matched with the power supply connection slots 12. The power supply connection ends 9 are arranged inside the plug-in slots 8 and the power supply connection slots 12 are formed inside the connection plugs 15, so that the plug-in connectors 3 can be connected with the power supply connection slots 12 through the power supply connection ends 9. Each plug-in connector 3 is electrified after being mounted, and is deenergized after being dismounted.

Connection line ports 10 are arranged inside the power supply connection ends 9, three connection lines which are respectively the positive-electrode line, the negative-electrode line and the signal line are arranged inside the connection line ports 10, line arranging slots 11 are formed inside the plug-in connectors 3. The connection line ports 10 are formed inside the power supply connection ends 9, so that the decorative lighting can be connected with the power supply connection ends 9 through the connection line ports 10 for being electrified. The positive-electrode line, the negative-electrode line and the signal line are arranged inside the connection line ports 10, so that the connection line ports 10 can be connected with LED lamps or RGB lamps.

Each rotating assembly 20 includes a movable barrel 5, a gear shaft 13, a rotating shaft 16, a damping gasket and an annular rack 17, where a movable slot 14 is formed inside the plug-in connector 3; the rotating shaft 16 is rotatably connected into the movable slot 14, the gear shaft 13 is fixedly connected onto the side wall of the rotating shaft 16, the annular rack 17 is fixedly connected onto the inner wall of the movable barrel 5, the annular rack 17 is engaged with the gear shaft 13, the movable barrel 5 is rotatably connected inside the plug-in connector 3 through the annular gear 17 and the gear shaft 13, and the damping gasket is fixedly connected to a joint of the movable barrel 5 and the plug-in connector 3. The gear shaft 13 and the annular rack 17 engaged with the gear shaft are arranged, so that the movable barrel 5 can rotate on the side wall of the plug-in connector 3 through the annular rack 17 and the gear shaft 13 without decorating the decorative lighting. The damping gasket is mounted at the joint of the movable barrel 5 and the plug-in connector 3. The damping gasket can rotate in the movable barrel 5 for fixing the movable barrel 5, so that the movable barrel 5 is prevented from automatically rotating subsequently.

Each fixing assembly 21 includes a mounting part 4, a fixing ring 6 and a fixing part 7, where the fixing part 7 is fixedly connected onto the side wall of the movable barrel 5, the mounting part 4 is fixedly connected inside the fixing part 7, and the fixing ring 6 is fixedly connected onto the side wall of the mounting part 4. The mounting part 4 is arranged, so that a lamp can be mounted inside the mounting part 4. The fixing part 7 is arranged, so that the mounting part 4 can be fixed inside the fixing part 7. The fixing ring 6 can increase load-bearing degree of the mounting part 4, so that the mounting part 4 is more stable. Branches of the Christmas tree are inserted into the fixing part 7. Through matching of bolts and screws, the branches of the Christmas tree are fixed inside the fixing part 7 via through holes in the fixing part 7.

The working principle and the use process of the prevent invention are: during mounting, the plug-in connectors 3 are plugged in the mounting slot of the mounting base 1, so that the plug-in connectors 3 are fixedly arranged inside the mounting base 1 to prevent the plug-in connectors 3 from dropping; the mounting base 1 is more stable through arranging the fixed supporting feet 2; the connection plugs 15 are arranged on the bottoms of the plug-in slots 8 in the tops of the plug-in connectors 3, so that the plug-in connectors 3 can be assembled and mounted, and the height can be adjusted by mounting the plurality of the plug-in connectors 3. The power supply connection slots 12 are formed inside the connection plugs 15 through the power supply connection ends 9 inside the plug-in slots 8, so that the plug-in connectors 3 can be connected with the power supply connection slots 12 through the power supply connection ends 9. Each plug-in connector 3 is electrified after being mounted and is deenergized after being dismounted. Connection line ports 10 are formed inside the power supply connection ends 9, so that the decorative lighting can be connected with the power supply connection ends 9 through the connection line ports 10 for being electrified. The positive-electrode line, the negative-electrode line and the signal line are arranged inside the connection line ports 10, so that the connection line ports 10 can be connected with the LED lamps, and also can be connected with the RGB lamps. The gear shafts 13 and the annular racks 17 engaged with the gear shafts are arranged, so that the movable barrel 5 can rotate on the side walls of the plug-in connectors 3 through the annular racks 17 and the gear shafts 13 without affecting the decorative lighting. A damping gasket is mounted at a joint of the movable barrel 5 and the plug-in connector 3. The damping gasket can rotate in the movable barrel 5 for fixing the movable barrel 5, so that the movable barrel 5 is prevented from shaking subsequently. The fixing part 7 can be arranged for fixing the mounting part 4 inside the fixing part 7. The fixing ring 6 can increase load-bearing degree of the mounting part 4, so that the mounting part 4 is more stable.

The above are only preferred embodiments of the present invention and are not intended to limit the present invention. Any equivalent structure modification made according to the contents of the specification and accompanying drawings in the present invention, under the concept of the present invention, no matter whether it is directly or indirectly used in any other related technical field, should be included within the protection scope of the present invention.

What is claimed is:

1. A lamp device capable of being rotated to plug in at any angle, comprising a mounting base, wherein side walls of the mounting base are fixedly connected with four fixed supporting feet, wherein the four fixed supporting feet are uniformly distributed on the side walls of the mounting base;

a plug-in slot is formed inside the mounting base, and a plurality of plug-in connectors are plugged in the plug-in slot; and rotating assemblies are arranged inside the plurality of plug-in connectors, and fixing assemblies are arranged on side walls of the plurality of plug-in connectors, wherein each of the rotating assemblies comprises a movable barrel, a gear shaft, a rotating shaft, a damping gasket and an annular rack, a movable slot is formed inside each of the plurality of plug-in connectors; and the rotating shaft is rotatably connected into the movable slot, the gear shaft is fixedly connected onto a side wall of the rotating shaft, the annular rack is fixedly connected onto an inner wall of the movable barrel, the annular rack is engaged with the gear shaft, the movable barrel is rotatably connected inside the each of the plurality of plug-in connectors through the annular rack and the gear shaft, and the damping gasket is fixedly connected to a joint of the movable barrel and the each of the plurality of plug-in connectors.

2. The lamp device according to claim 1, wherein plug-in slots are formed at tops of the plurality of plug-in connectors, and bottoms of the plurality of plug-in connectors are fixedly connected with connection plugs;

the connection plugs are matched with the plug-in slots; and the plurality of plug-in connectors are connected to the connection plugs at bottoms of the connection plugs through the plug-in slots at the tops of the plurality of plug-in connectors end to end.

3. The lamp device according to claim 2, wherein power supply connection ends are fixedly connected inside the plug-in slots, power supply connection slots are formed inside the connection plugs, and the power supply connection ends are matched with the power supply connection slots.

4. The lamp device according to claim 3, wherein connection line ports are arranged inside the power supply connection ends;

and line arranging slots are formed inside the plurality of plug-in connectors.

5. The lamp device according to claim 1, wherein each of the fixing assemblies comprises a mounting part, a fixing ring and a fixing part;

the fixing part is fixedly connected on a side wall of the movable barrel; and the mounting part is fixedly connected inside the fixing part and the fixing ring is fixedly connected onto a side wall of the mounting part.

* * * * *